US010232579B2

(12) United States Patent
Shaffer

(10) Patent No.: US 10,232,579 B2
(45) Date of Patent: Mar. 19, 2019

(54) APPARATUS FOR THE PLACEMENT OF A SECOND MATERIAL PIECE ON A PAPERBOARD CUTOUT AND METHODS THEREOF

(71) Applicant: Jeffrey Allen Shaffer, Hickory, NC (US)

(72) Inventor: Jeffrey Allen Shaffer, Hickory, NC (US)

( * ) Notice: Subject to any disclaimer, the term of this patent is extended or adjusted under 35 U.S.C. 154(b) by 363 days.

(21) Appl. No.: 15/223,868

(22) Filed: Jul. 29, 2016

(65) Prior Publication Data

US 2017/0028664 A1 Feb. 2, 2017

Related U.S. Application Data

(60) Provisional application No. 62/199,531, filed on Jul. 31, 2015.

(51) Int. Cl.

| | |
|---|---|
| ***B31B 50/82*** | (2017.01) |
| ***B31B 50/10*** | (2017.01) |
| *B31B 50/16* | (2017.01) |
| *B31B 100/00* | (2017.01) |
| *B31B 50/12* | (2017.01) |
| *B31B 110/35* | (2017.01) |

(52) U.S. Cl.

CPC ..... *B31B 50/10* (2017.08); *B31B 50/102* (2017.08); *B31B 50/12* (2017.08); *B31B 50/16* (2017.08); *B31B 50/82* (2017.08); *B31B 2100/00* (2017.08); *B31B 2110/35* (2017.08)

(58) Field of Classification Search

CPC ..... B31B 50/82; B31B 50/102; B31B 50/16; B31B 2100/00; B31B 2110/35; B31B 50/12

USPC .... 493/332, 199, 287, 288, 340; 83/152, 49, 83/37, 303, 346

See application file for complete search history.

(56) References Cited

U.S. PATENT DOCUMENTS

| | | | | |
|---|---|---|---|---|
| 3,325,335 A * | 6/1967 | Martensson | ..... | B65C 1/025 156/498 |
| 4,642,085 A * | 2/1987 | Helm | ..... | B31B 50/00 156/514 |
| 4,651,500 A * | 3/1987 | Chaffey | ..... | B65B 25/146 269/269 |
| 4,664,648 A * | 5/1987 | Dupuy | ..... | B65D 5/4204 229/162.7 |

(Continued)

*Primary Examiner* — Sameh Tawfik

(74) *Attorney, Agent, or Firm* — Seth L. Hudson; Clements Bernard Walker PLLC

(57) ABSTRACT

The present invention provides methods and systems for applying a second-piece material to a paperboard cutout that includes a conveyor belt used for transporting the paperboard cutouts, a vacuum belt, at least two metering rolls, a first roller and second roller in a spaced apart and planar relationship, a nip roller positioned adjacent the second roller, and a cutting device. The vacuum belt proceeds over the first roller and the at least two metering rolls meter the second-piece material thereon, the vacuum belt proceeds through a valley between the first roller and second roller, at a predetermined time, the nip roller continues to pull the vacuum belt and the metering rolls pull back slightly and pulling the second-piece material taught and causing the second-piece material to contact the cutting device, and thus cutting the second-piece material.

4 Claims, 7 Drawing Sheets

(56) References Cited

U.S. PATENT DOCUMENTS

| | | | | | |
|---|---|---|---|---|---|
| 4,685,318 | A * | 8/1987 | Ueda | B21D 13/04 | 72/185 |
| 5,024,128 | A * | 6/1991 | Campbell, Jr. | B26D 1/626 | 83/107 |
| 5,197,812 | A * | 3/1993 | Worley | B41J 11/007 | 198/811 |
| 5,207,083 | A * | 5/1993 | Bongiovanni | B21D 13/04 | 72/185 |
| 5,213,560 | A * | 5/1993 | Crowley | B42B 5/00 | 156/277 |
| 5,582,571 | A * | 12/1996 | Simpson | B26F 1/18 | 493/355 |
| 5,660,674 | A * | 8/1997 | Saindon | B26D 5/20 | 156/353 |
| 5,689,986 | A * | 11/1997 | Jacobs, Jr. | B23D 15/00 | 72/11.1 |
| 5,727,367 | A * | 3/1998 | Cahill | B65B 19/228 | 493/459 |
| 6,062,285 | A * | 5/2000 | Dotta | A61F 13/0279 | 156/265 |
| 6,217,497 | B1 * | 4/2001 | Laudenberg | B31B 50/00 | 493/11 |
| 6,247,293 | B1 * | 6/2001 | Todd | B29C 65/18 | 53/329.2 |
| 6,273,313 | B1 * | 8/2001 | Noll | B65H 23/1882 | 226/30 |
| 7,311,647 | B2 * | 12/2007 | Delisle | B29C 65/08 | 493/10 |

* cited by examiner

APPARATUS FOR THE PLACEMENT OF A SECOND MATERIAL PIECE ON A PAPERBOARD CUTOUT AND METHODS THEREOF

CROSS REFERENCE TO RELATED PATENT APPLICATION

The present non-provisional patent/patent applications claims priority to U.S. Provisional Patent Ser. No. 62/199,531 filed Jul. 31, 2015 and entitled "APPARATUS FOR THE PLACEMENT OF A SECOND MATERIAL PIECE ON A PAPERBOARD CUTOUT AND METHODS THEREOF," the contents of which are incorporated by reference herein.

FIELD OF THE INVENTION

The present invention relates generally to a device and process for the production of foldable paperboard cutouts with glued-on second-material pieces, such as film pieces. In addition, the present invention includes a novel apparatus for cutting the second-material pieces and gluing station for gluing the second-material pieces to the paperboard.

BACKGROUND OF THE INVENTION

In the field of window gluing-in for paperboard cartons, corresponding machines have long been known. The basic principle of these machines lies in that paperboard cutouts from a storage container are isolated, then aligned in a conveyor belt station in running direction and in transverse direction, then glued in a gluing station by means of a block cylinder, in order then to be fed to a suction cylinder which applies the film piece to the glued paperboard cutout. The transport of the paperboard cutouts from the gluing mechanism to the suction cylinder occurs, there, preferably by means of suction bands or belts, depending on machine width and construction type, between 1 and 12 suction bands.

Prior art describes a process for the continuous production of folding boxes, in which a window opening zone is glued over with a film piece of flexible plastic material. The film is drawn off from the supply roller, cut into pieces and glued in exact fit over the pre-stamped window opening zones.

Other prior art describes a process for the production of film cutouts for folding boxes with angle windows, in which film cutouts from a transparent plastic are glued into folding boxes provided with a cutout. The material for the film cutouts is unwound there continuously from a roller and the film cutouts for the production of folding boxes are glued with the folding box cutouts.

With the aforementioned devices, the precise alignment of the cutouts is not possible. It is an object of the present invention to provide an apparatus and method that allows for the expeditious and accurate application of a second-material piece that is accurately aligned.

BRIEF SUMMARY OF THE INVENTION

Underlying the invention is the problem of showing an apparatus and process by means of which the above-mentioned disadvantages can be avoided. It is desirable that a high precision can be guaranteed for the placing of the second-piece materials, such as film, on the paperboard cutouts, with simultaneously a high production rate, and with the aim of drastically reducing the costs for the production and the maintenance of the production installation. In the present invention, a process is claimed for the production of paperboard cutouts with glued on second-material pieces, preferably film pieces for use as folding boxes with a film window, in which the paperboard cutouts are glued at a gluing manifold employing two extrusion gun banks for creating both solid and horizontal lines on the exterior of the window prior to application of the film.

According to an embodiment of the present invention, an apparatus for applying a second-piece material to a paperboard cutout that includes a vacuum belt, at least two metering rolls, a first roller and second roller in a spaced apart relationship, and a nip roller.

According to an embodiment of the present invention, an apparatus for applying a second-piece material to a paperboard cutout that includes a cutting device with a serrated blade.

According to an embodiment of the present invention, an apparatus for applying a second-piece material to a paperboard cutout that includes a cutting device with a removable blade.

According to an embodiment of the present invention, an apparatus for applying a second-piece material to a paperboard cutout that includes a vacuum belt positioned over the first roller and second roller.

According to an embodiment of the present invention, an apparatus for applying a second-piece material to a paperboard cutout that includes a second-piece material that is metered by the at least two metering rollers.

According to an embodiment of the present invention, an apparatus for applying a second-piece material to a paperboard cutout that includes a second-piece material that is a plastic film.

According to an embodiment of the present invention, an apparatus for applying a second-piece material to a paperboard cutout that includes a conveyor belt, a vacuum belt, at least two metering rolls, and a first roller and a second roller in a spaced apart and planar relationship. A nip roller is positioned adjacent the second roller, and a cutting device is spaced apart from the first roller and second roller. The vacuum belt proceeds over the first roller and the at least two metering rolls meter the second-piece material thereon. The vacuum belt proceeds through a valley between the first roller and second roller, and at a predetermined time, the nip roller continues to pull the vacuum belt and the metering rolls pull back slightly, pulling the second-piece material taught and causing the second-piece material to contact the cutting device, and thus cutting the second-piece material.

According to another embodiment of the present invention, the apparatus for applying a second-piece material to a paperboard cutout that includes a cutting device that is a serrated knife.

According to yet another embodiment of the present invention, the apparatus for applying a second-piece material to a paperboard cutout that includes a gluing manifold, whereby the gluing manifold deposits an adhesive on the paperboard cutout prior to the conveyor belt conveying the paperboard cutouts in close proximity thereto.

According to yet another embodiment of the present invention, the apparatus for applying a second-piece material to a paperboard cutout that includes a UV light for curing an adhesive.

According to yet another embodiment of the present invention, a process for applying a second-piece material to a paperboard cutout that includes providing a conveyor belt used for transporting the paperboard cutouts, a vacuum belt, at least two metering rolls, a first roller and second roller in a spaced apart and planar relationship, a nip roller positioned adjacent the second roller, and a cutting device. The paperboard cutouts are conveyed along the conveyor belt, and the second-piece material is metered through at least two metering rolls and onto the vacuum belt. The vacuum belt and second-piece material are transported over the first roller and the second roller, including a valley disposed between the first roller and second roller. The metering rolls stop at a predetermined time and the metering rolls are backed up a slight amount, causing the second-piece material becoming taught and moving upwards rapidly from the valley and coming in contact with the cutting device, which cuts the second piece material. The second-piece material being applied to the paperboard cutout.

According to yet another embodiment of the present invention, the process for applying a second-piece material to a paperboard cutout that includes a serrated knife as the cutting device.

According to yet another embodiment of the present invention, the process for applying a second-piece material to a paperboard cutout that includes a plastic film as the second-piece material.

According to yet another embodiment of the present invention, the process for applying a second-piece material to a paperboard cutout that includes a gluing manifold, whereby the gluing manifold deposits an adhesive on the paperboard cutout prior to the conveyor belt conveying the paperboard cutouts in close proximity thereto.

According to yet another embodiment of the present invention, the process for applying a second-piece material to a paperboard cutout that includes a UV activated adhesive.

According to yet another embodiment of the present invention, the process for applying a second-piece material to a paperboard cutout that includes an antistatic ion bar.

BRIEF DESCRIPTION OF THE DRAWINGS

The present invention is illustrated and described herein with reference to the various drawings, in which like reference numbers denote like method steps and/or system components, respectively, and in which.

DETAILED DESCRIPTION OF THE INVENTION

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

The present invention relates to an apparatus and process for the application of second-material pieces to paperboard cutouts for use on folding cartons with window cutouts. The paperboard cutout contains a window designed to allow the consumer to view the actual contents of the package. During production, a second-material piece is adhered around the window. An adhesive is applied around the window and a second-material piece is placed upon the adhesive. It is an object of the present invention to apply the second-material piece in an expeditious and accurate manner.

Figure 4:
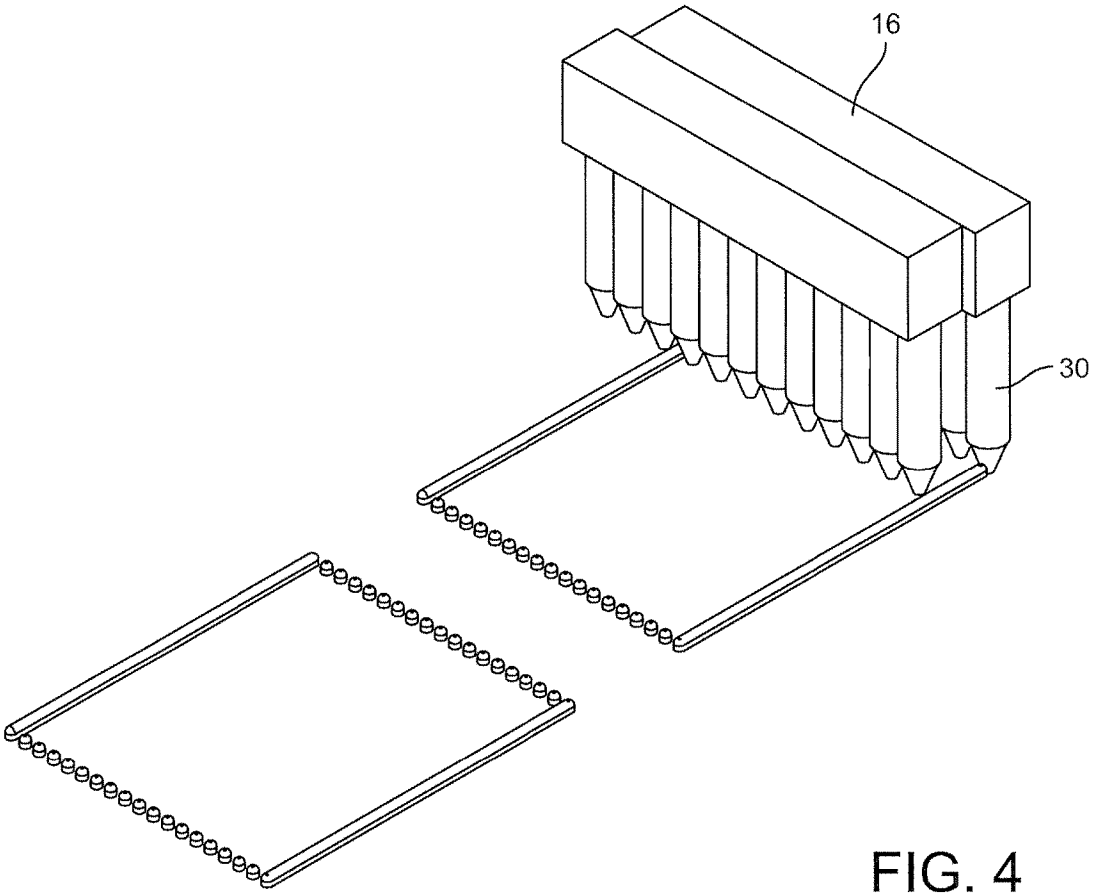
FIG. 4 is a perspective view of the gluing manifold.
Figure 5:
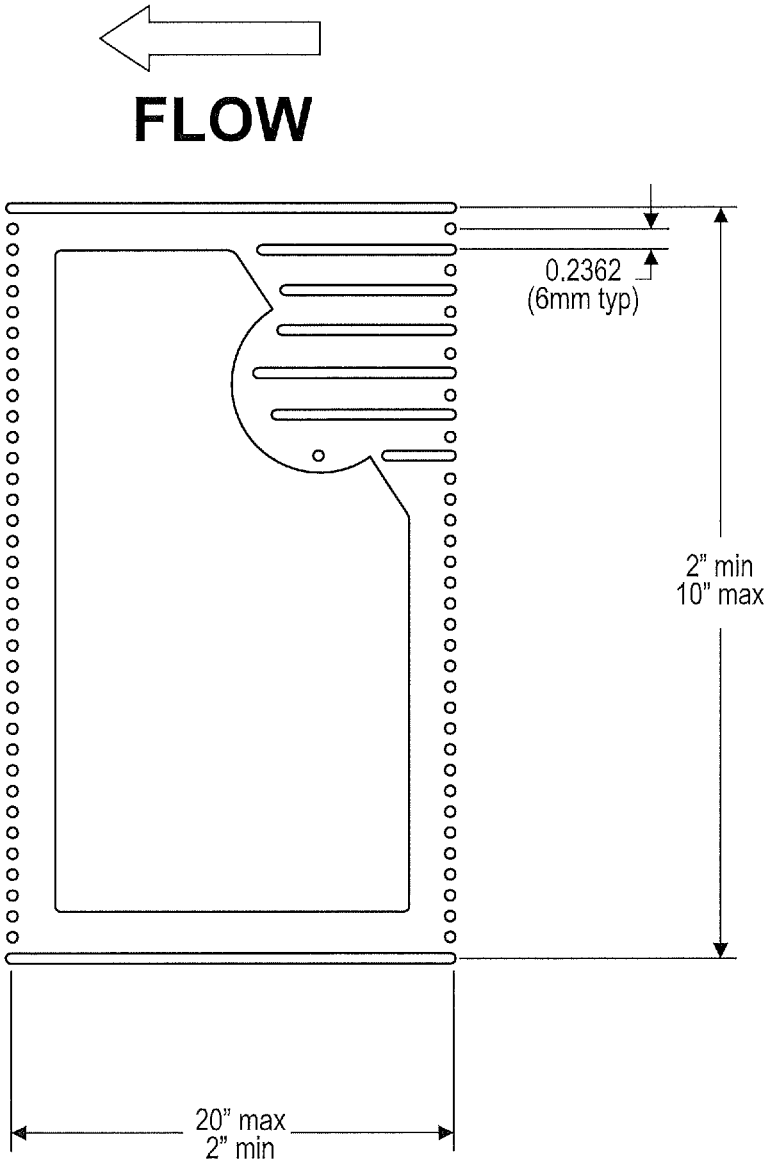
FIG. 5 is a perspective view of an alternative embodiment of the gluing manifold.
Figure 6:
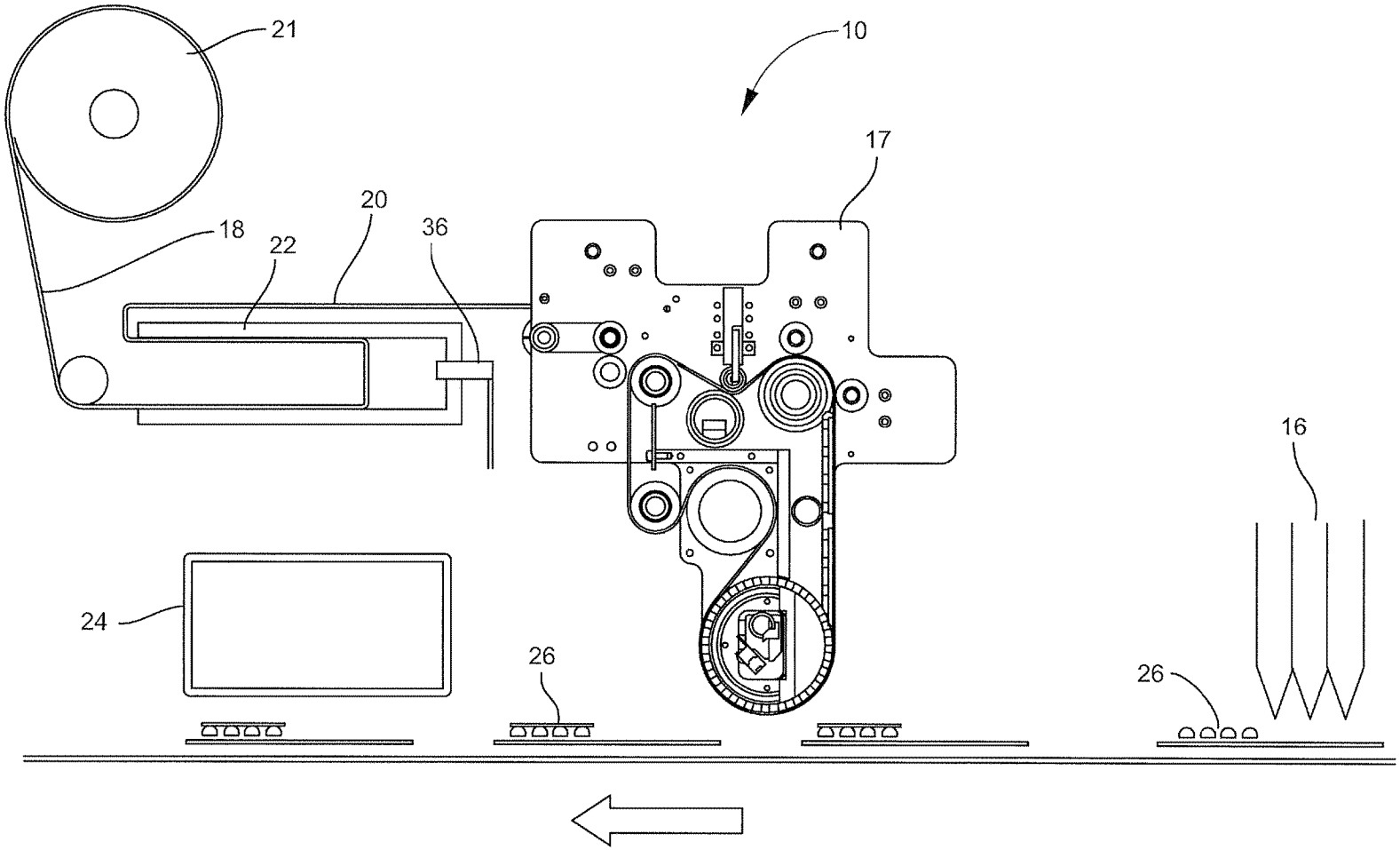
FIG. 6 is a view of the apparatus and process for the application of second-material pieces to paperboard cutouts and a gluing manifold.

Referring now specifically to the figures, an improved apparatus for the placement of a second-material piece on a paperboard cutout and method thereof is illustrated in FIGS. 1-7 and is shown generally at reference numeral 10. Paperboard cutouts 12 are drawn off a storage container (not shown) and conveyed over a conveyor belt 14 and through a gluing manifold 16, as illustrated in FIG. 6. Once the paperboard cutouts 12 exit the gluing manifold 16 they pass under a vacuum device 17, which applies the second-material piece, such as a plastic film 18, over a window within the paperboard cutout 12.

Figure 2:
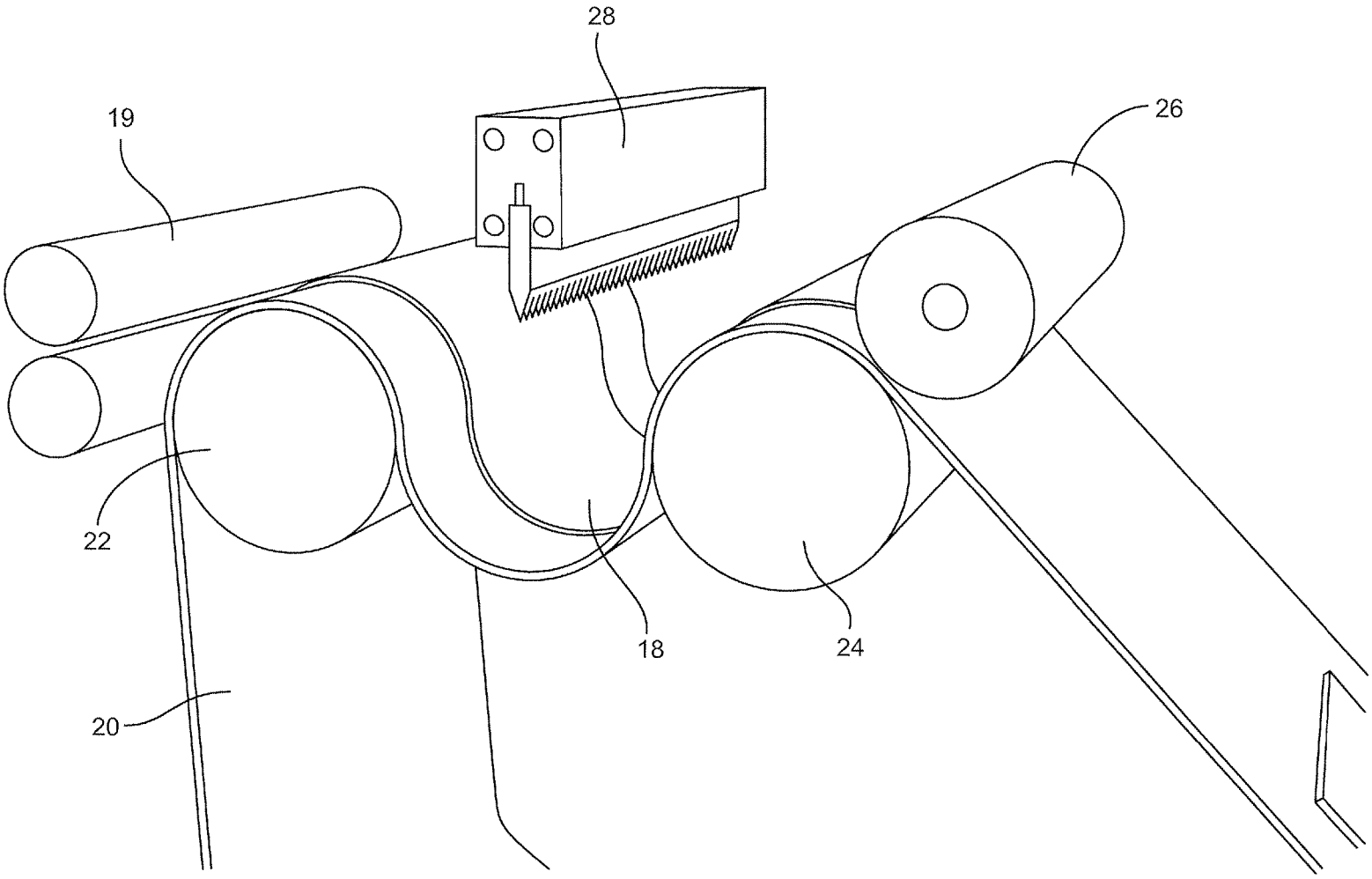
FIG. 2 is a perspective view the cutting sequence within the vacuum device.
Figure 3:
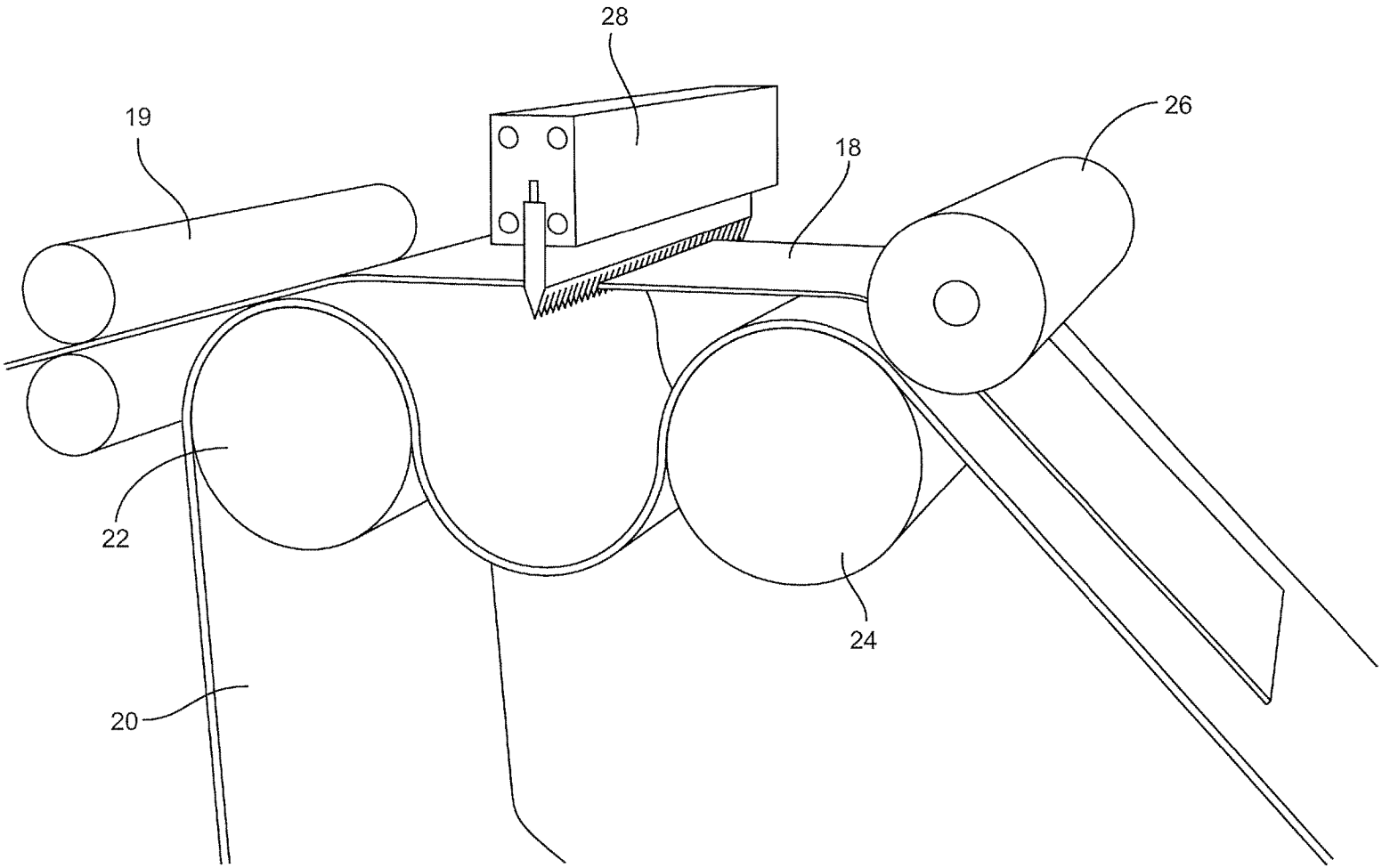
FIG. 3 is another perspective view of the cutting sequence within the vacuum device.

The apparatus 10 contains an expeditious cutting apparatus 11 and process for cutting the plastic film 18, as illustrated in FIGS. 2, 3, and 6. The plastic film 18 is drawn off a roll 21 and metered out by an accumulator 22. The plastic film 18 enters the cutting apparatus 11 and is pulled through a pair of metering rolls 19 and onto a vacuum belt 20. The cutting apparatus is contained within the vacuum device 17. The vacuum belt 20 pulls the film 18 onto the vacuum belt 20 and through the metering rolls 19, which may be driven by a servo motor (not shown). Adjacent to the metering rolls 19 is a first roller 22 and second roller 24. The vacuum belt 20 is drawn over the first roller 22, wherein the plastic film 18 is deposited on the vacuum belt 20. The vacuum belt 20 extends within a valley between the first roller 22 and second roller 24. In this valley, the vacuum belt 20 extends below the bottom portion of the first roller 22 and second roller 24, and as a consequence the plastic film 18 on the vacuum belt 20 also extends below the first roller 22 and second roller 24 via suction.

During use, as the vacuum belt 20 pulls the film 18 between the metering rolls 19. The film 18 is deposited on the vacuum belt 20 and continues down the valley between the first roller 22 and the second roller 24. The film 18 and vacuum belt 20 are pulled between a nip roller 26 and the second roller 24. Once a desired amount of film 18 has been drawn, the metering rolls 19 stop and back up a slight amount, while the nip roller 26 continues to pull the film 16, causing the film 16 to rise out of the valley in a taught position.

A cutting device 28 is positioned above the valley. Preferably, the cutting device 28 contains a serrated blade that is easily replaceable within the system 10. As the film 16 rises out of the valley, it is snapped taught across the blade of the cutting device 28, cutting the film 18, as shown in FIG. 3. During the cutting process, a portion of the film 18 is still engaged to the vacuum belt 20, and after the cut has been administered to the film 18, the film 18 continues down the vacuum belt 20. The process is repeated numerous times.

Figure 1:
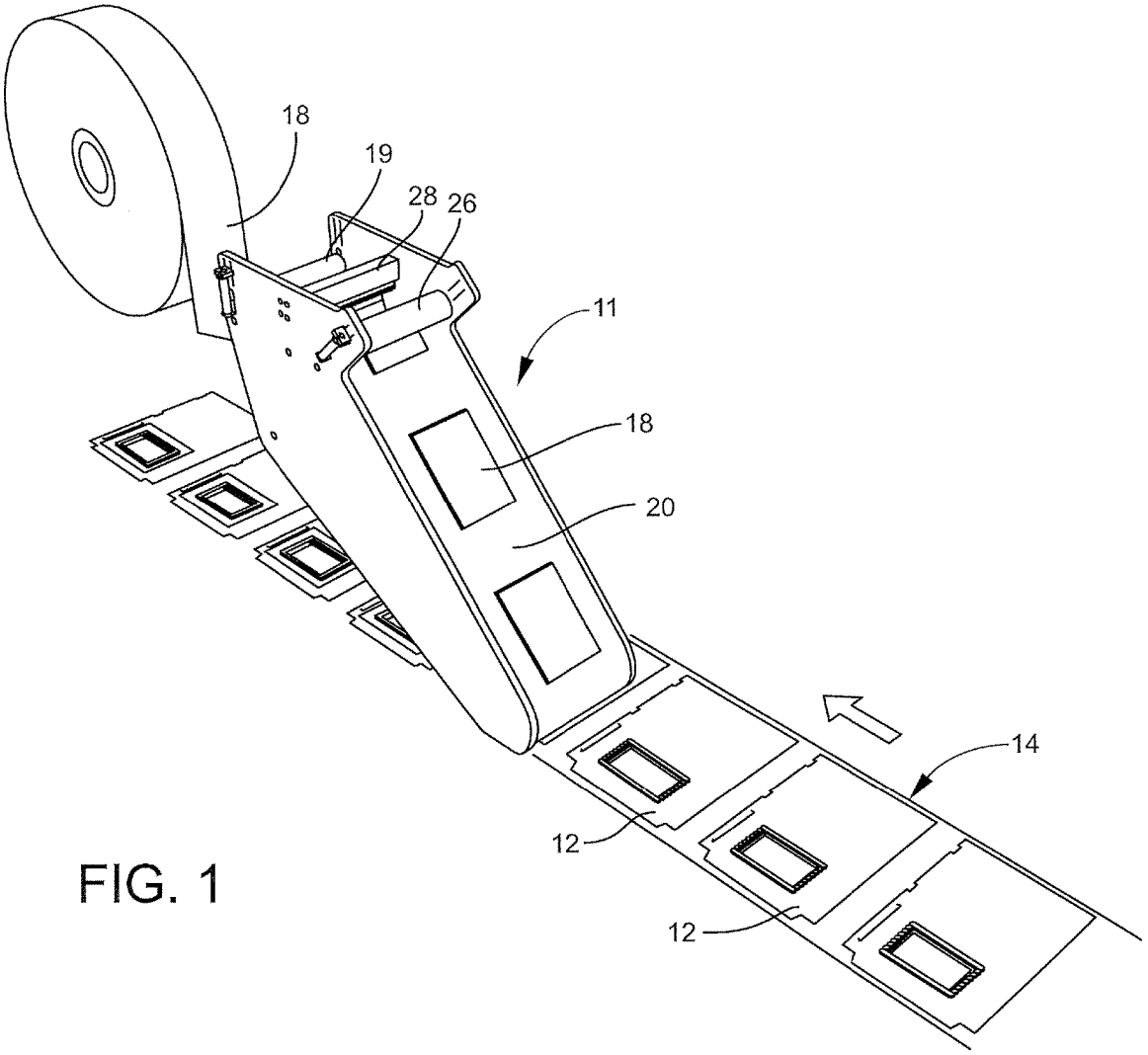
FIG. 1 is a perspective view of an embodiment of the present invention.

As illustrated in FIG. 1, the film 16 is deposited on the paperboard cut-outs 12. The gluing manifold 16 is illustrated in FIG. 4. The gluing manifold 16 consists of at least one or a plurality of extrusion guns 30 that extrude an adhesive on the paperboard cutouts 12. As illustrated, the gluing manifold 16 consists of two extrusion gun banks that are staggered, such that each lane is in a spaced-apart relationship to create enough spacing for a solid seal when needed. By way of example only, the extrusion gun banks may be spaced apart from between 1 mm to about 12 mm (including all points in-between). It should be noted that the system 10 may include one or more extrusion gun banks, including between about one and about twenty extrusion gun banks, including all points in-between. During use and depending upon the desired deposition of adhesive, two guns fire solid lines onto the paperboard cutout 12 while the guns situated between these two guns fire dots in two predisposed places, creating two horizontal lines. The pattern illustrated in FIG. 4 is designed to go with the window configuration as shown on the paperboard cutouts 12 in FIG. 1. The glue deposited on the paperboard cut-out 12 is designed to be positioned around the window and prior to the film 18 being deposited on the paperboard cutout 12, for adhering the film 18 to the paperboard cutout and around the window.

FIG. 5 illustrates an alternative gluing manifold 16. In this embodiment, one or more extrusion guns are staggered such that each lane is spaced-apart. Two or more extrusion guns deposit adhesive in a solid line or dotted lines while the extrusion guns are situated between fire dots in two places, such that it creates two horizontal lines along a lead and trail edge. When the adhesive is compressed to the film, it creates a solid seal. For odd shaped openings with chamfered corners, logo emblems or other character edges, the extrusion guns can be easily programmed to create dots and dashes of lines in areas to secure the film tightly and control the carton substrate to the film without a complex flexo pad.

The apparatus 10 may also include a sensor (not shown), such as a reflective eye or laser sensor, for sensing the paperboard cutouts 12. The sensor rhythmically checks the presence and times the presence of the paperboard cutouts 12. The sensor assists in the timing of the film 18 application and matches the speed of the film 18 application with the speed of the paperboard cutouts 12 that are progressing under the vacuum belt 20. Additionally, the sensor may detect if a paperboard cutout 12 is missing and stop the application of the film 18, but restart the application of the film 18, once another paperboard cutout 12 is detected. The sensor or in another embodiment sensors can auto-detect the carton edge plus the window opening position. This can automatically set the lead edge and trail edge of the adhesive and film. Cartons or substrates with variable size and position of openings could run through in a consecutive stream and an "auto-detect" scenario will place film and adhesive only where required. One such application would be multiple openings along the same substrate. These could be same or different sized. The auto-detect scenario would place films and adhesives over the openings at optimal lengths.

An accumulator 22 or another way of collecting the film in-between the continuous unwind and the intermittent discharge may be incorporated with the vacuum device 17. The film is fed into the accumulator 22, wherein an ultrasonic sensor 36, senses the position of the film and amount of film deposited in the accumulator 22 from the roll 21. The film is drawn from the accumulator 22 and into the vacuum device 17.

A UV light 24 may be positioned downstream the vacuum belt 20. The adhesive 26 that is deposited by the gluing manifold may be a UV cured adhesive. This adhesive is particularly useful when an inadvertent drop of the adhesive is deposited on an area of the paperboard cutout 12 that is not attended. The adhesive will cure after passing through the UV light 24.

Figure 7:
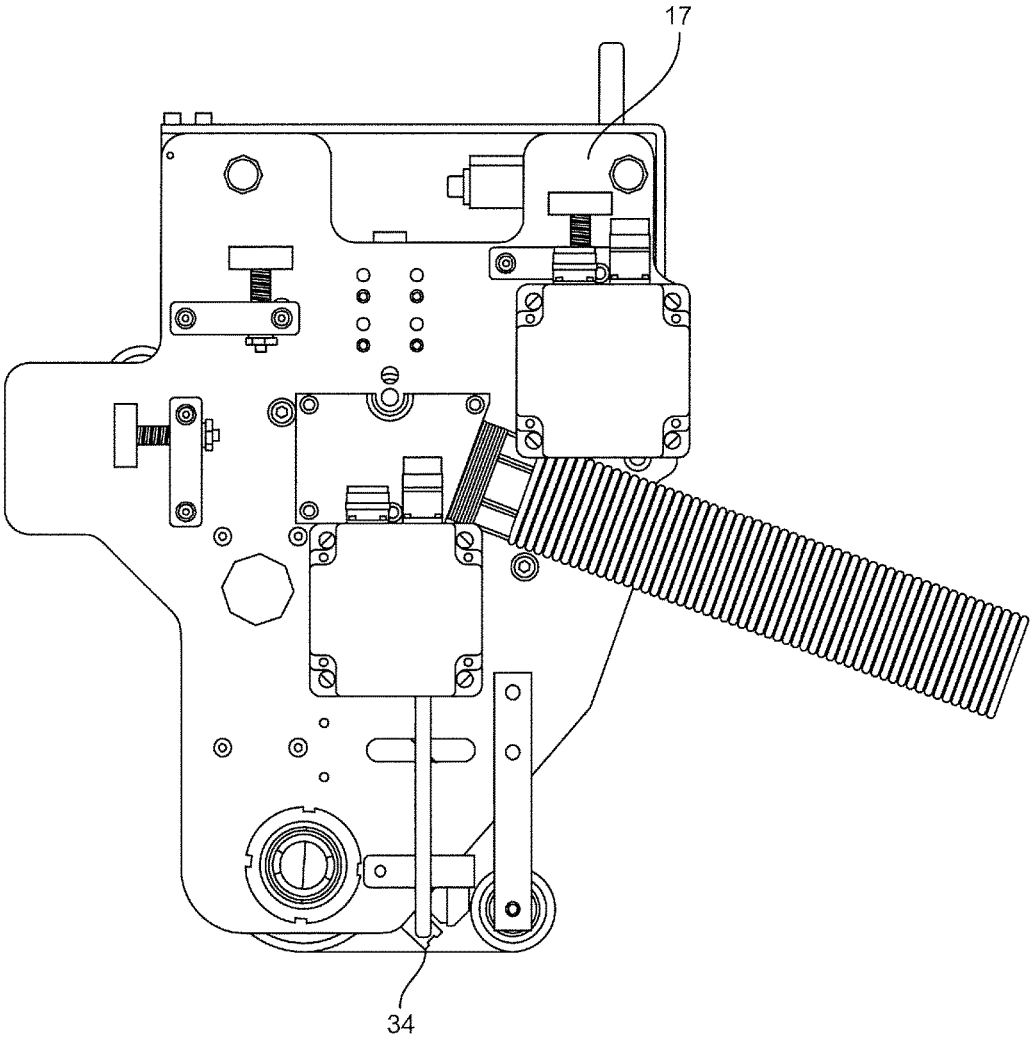
FIG. 7 is a side-view of the cutting apparatus.

As shown in FIG. 7, an antistatic ion bar 34 may be positioned adjacent the vacuum belt for dispersing static electricity. The antistatic ion bar 32 produces negative and positive ions, or may just product negative ions or positive ions. The ions are dispersed such that the ions contact the film for removing static electricity that may build up during operation.

While the second-piece material has been described herein as a plastic film, it is noted that other materials may consist of the second-piece material. Such materials mas consist of wrapping paper, laminate, or the like.

The paperboard may be corrugated, plastic, or any other flat blank with a window opening.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

What is claimed is:

1. An apparatus for applying a second-piece material to a paperboard cutout, comprising:

a conveyor belt conveying the paperboard cutout;

a vacuum belt conveying the second-piece material;

at least two metering rolls;

a first roller and second roller in a spaced apart and planar relationship;

a nip roller positioned adjacent the second roller; and a cutting device whereby the vacuum belt proceeds over the first roller and the at least two metering rolls meter the second-piece material thereon, the vacuum belt proceeds through a valley between the first roller and second roller, at a predetermined time, the nip roller continues to pull the vacuum belt and the metering rolls pull back slightly and pulling the second-piece material taught and causing the second-piece material to contact the cutting device, and thus cutting the second-piece material further comprising a gluing manifold, whereby the gluing manifold deposits an adhesive on the paperboard cutout prior to the conveyor belt conveying the paperboard cutouts in close proximity thereto.

2. The apparatus for applying a second-piece material to a paperboard cutout of claim 1, wherein the cutting device is a serrated knife.

3. The apparatus for applying a second-piece material to a paperboard cutout of claim 1, wherein the second-piece material is a plastic film.

4. The apparatus for applying a second-piece material to a paperboard cutout of claim 1, further comprising a UV light for curing an adhesive used to engage the second-piece material to the paperboard cutout.

* * * * *